US006078003A

United States Patent [19]

DeVito

[11] Patent Number: 6,078,003

[45] Date of Patent: Jun. 20, 2000

[54] DRUM HEAD RETENTION RING WITH J-SLOTS

[76] Inventor: Todd J. DeVito, 17 Ocean Vista, Newport Beach, Calif. 92660

[21] Appl. No.: 09/285,737

[22] Filed: Apr. 5, 1999

[51] Int. Cl.[7] ..... G10D 13/02

[52] U.S. Cl. ..... 84/411 R; 84/421

[58] Field of Search ..... 84/411 R, 421, 84/327, 453

[56] References Cited

U.S. PATENT DOCUMENTS

| | | | |
|---|---|---|---|
| 519,914 | 5/1894 | Koeth . | |
| 674,550 | 5/1901 | Zeidler . | |
| 3,029,679 | 4/1962 | La Londe . | |
| 4,188,852 | 2/1980 | Light . | |
| 4,373,419 | 2/1983 | Tuttrup . | |
| 4,475,434 | 10/1984 | Willis . | |
| 4,506,586 | 3/1985 | Brewer | 84/413 |
| 5,450,780 | 9/1995 | Hoshino | 84/413 |
| 5,739,448 | 4/1998 | Toscano | 84/413 |

*Primary Examiner*—Stanley J. Witkowski
*Assistant Examiner*—Kim Lockett
*Attorney, Agent, or Firm*—William W. Haefliger

[57] ABSTRACT

In drum head retention apparatus, the combination comprises a ring to extend about the drum, in alignment with head tensioners; fingers projecting on the ring to form slots to rotatably receive and to release from the tensioners; and relieved zones on the ring to pass the tensioners endwise when the fingers are in rotatably displaced positions relative to the tensioners.

17 Claims, 3 Drawing Sheets

4
15
17
19
12
25
13
10
26
18
19a
12a
14
4
21
11a
20
29
27
28
30
11

15
25
35
50
21
50
11

DRUM HEAD RETENTION RING WITH J-SLOTS

BACKGROUND OF THE INVENTION

This invention relates generally to retention of drum tensioner rods in position adjacent drum shells, and more particularly to provision of an improved retention ring configured to enable rapid and accurate assembly of the ring to multiple tensioner rods, to hold them in position for adjustably tensioning a drum head.

There is need for improvements in drum head retention rings which will rapidly assemble to multiple tensioner rods, and particularly to rods of different diameters as are provided on different drums. There is also need for such rings which will not interfere, during assembly with straps which are used with auxiliary equipment on drums.

SUMMARY OF THE INVENTION

It is a major object of the invention to provide an improved retention ring configuration or configurations, meeting the above needs. Basically, the ring apparatus of the invention comprises:

a) a ring to extend about the drum, in alignment with head tensioners, and b) fingers projecting on the ring to form slots to rotatably receive and to release from the tensioners, c) relieved zones on the ring to pass the tensioners endwise when the fingers are in rotatably displaced positions relative to the tensioners.

These and other objects and advantages of the invention, as well as the details of an illustrative embodiment, will be more fully understood from the following specification and drawings, in which:

DRAWING DESCRIPTION

DETAILED DESCRIPTION

Figure 1:
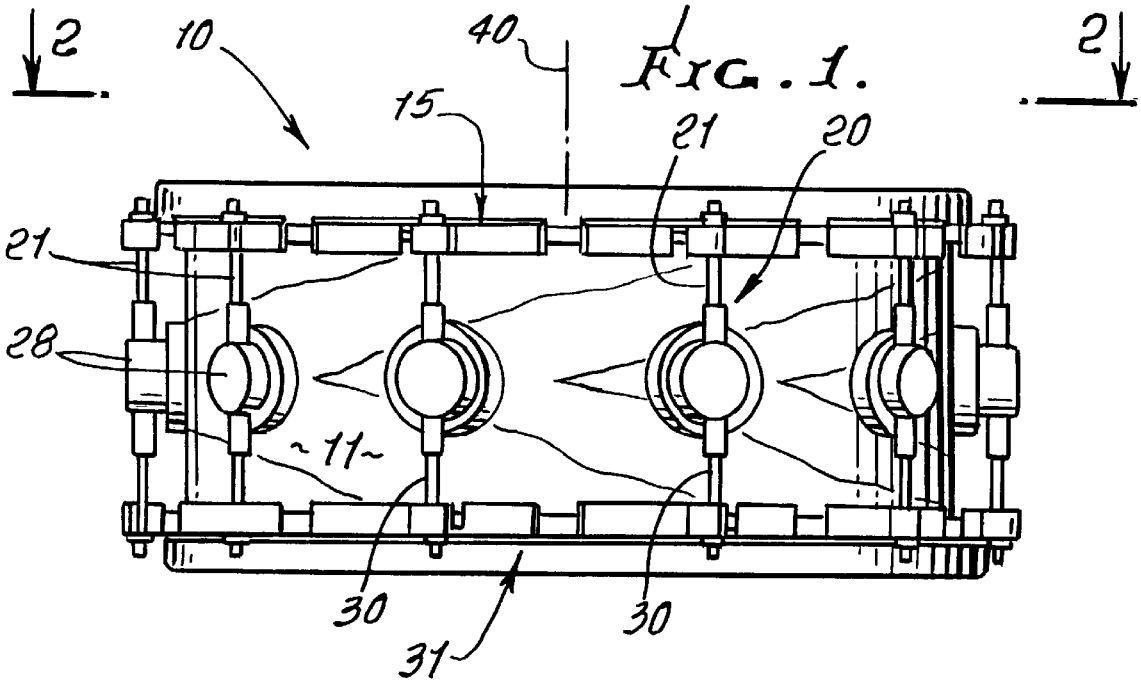
FIG. 1 is a side elevation of a drum incorporating the invention.
Figure 2:
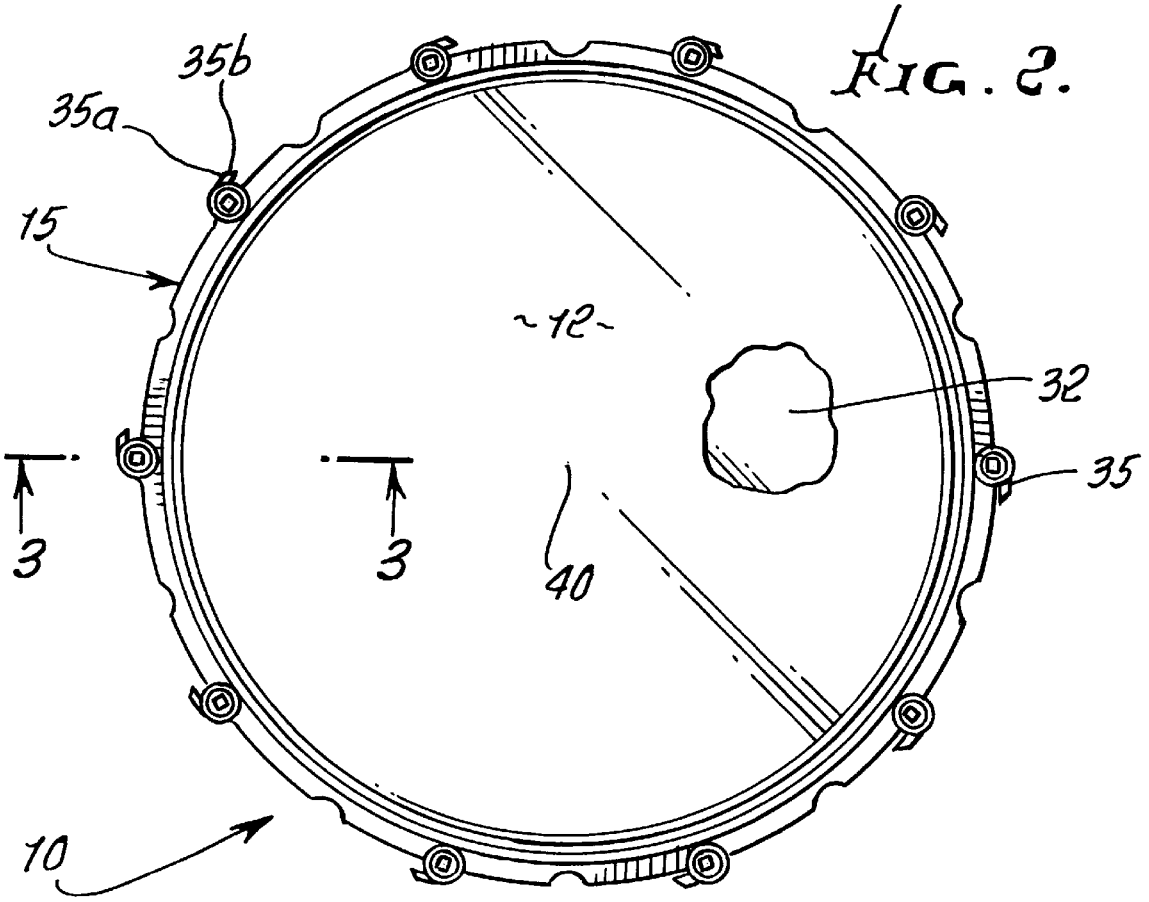
FIG. 2 is a plan view taken on lines 2—2 of FIG. 1.

Referring to FIGS. 1–4, a drum 10 has a cylindrical shell 11 with a drum head attached to the upper annular end portion 11*a* of the shell. The head includes a thin sheet 12 stretched over the annular edge 13 of end portion 11*a*, and a lip 12*a* of the head is carried by a tension ring 14 extending about shell end portion 11*a*.

Figure 3:
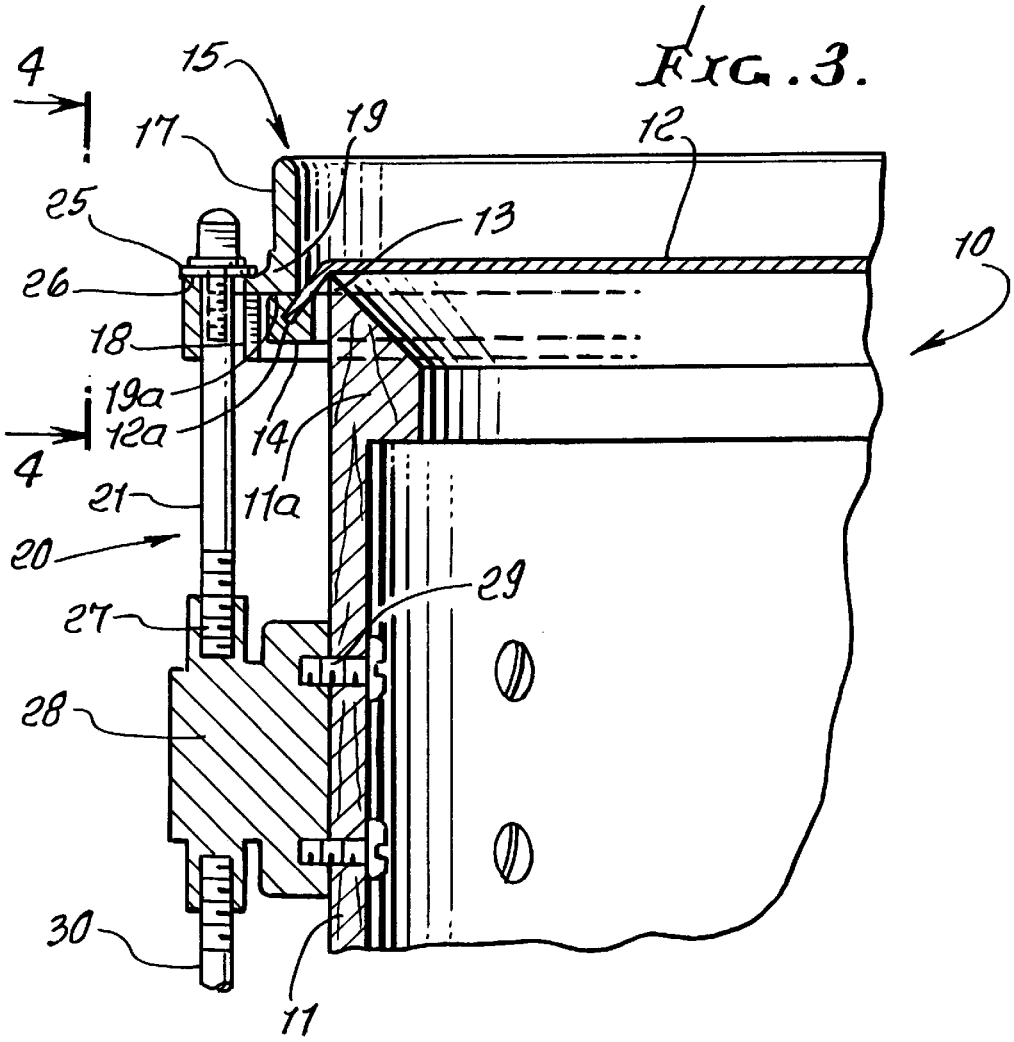
FIG. 3 is an enlarged section taken on lines 3—3 of FIG. 2.
Figure 4:
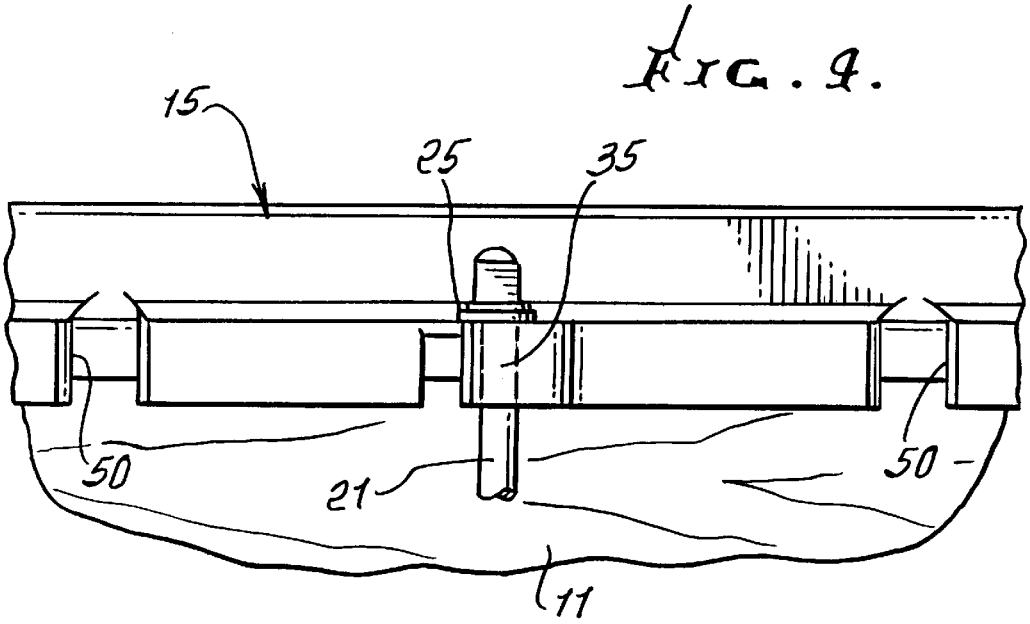
FIG. 4 is a fragmentary side elevation taken on lines 4—4 of FIG. 3.

A retainer ring 15 is provided and located to urge the tensioner ring 14 in a downward direction in FIG. 3. The retainer ring includes an upper annular wall 17, a lower annular wall 18 offset from wall 17, and an intermediate stepped portion 19 between walls 17 and 18. The stepped portion 19 has a lower shoulder 19*a* seating on tensioner ring 14 for urging ring 14 downwardly, in response to tightening of tensioners 20 spaced about the shell and urging ring 15 downwardly. Tensioners 20 include rods 21 that are adjustable to adjust the downward force exerted by ring 14. As shown, a tensioner flange 25 seats at 26 on the upper surface of ring 15, and on the top of a finger 35, and as the associated rod 21 is rotated in one direction, the flange pushes downwardly at 26. That seating surface may be knurled to enhance friction grip of the flange to the seat. Note the threaded lower end portion 27 of the tensioner rod, that engages threads in a lug or protrusion 28 attached at 29 to the shell. A lower tensioner rod 30 exerts upward force on a lower retainer ring 31 corresponding to ring 15, for adjustably tensioning force exertion on a lower drum head 32 corresponding to upper head 12.

Figure 5:
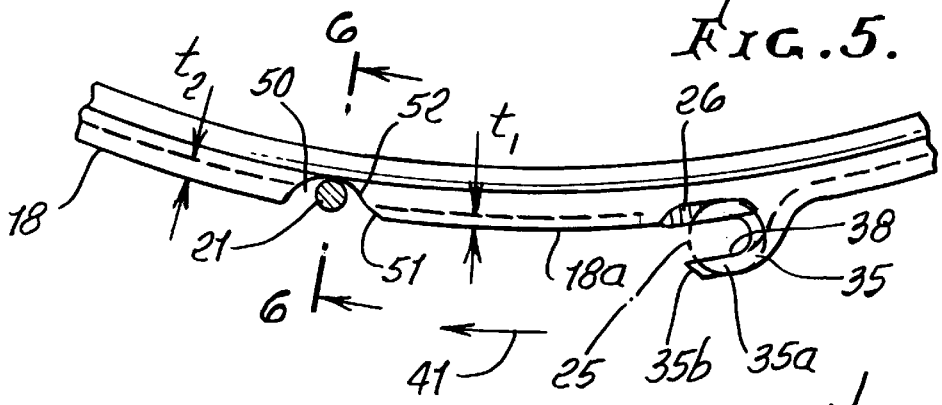
FIG. 5 is an enlarged fragmentary plan view showing tensioner reception in relieved zones such as notches in a ring that carries the fingers.
Figure 6:
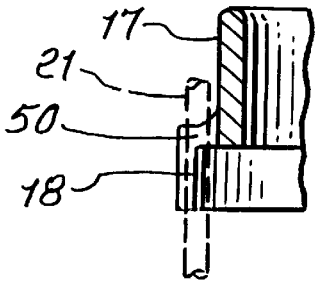
FIG. 6 is a section taken on lines 6—6 of FIG. 5.

In accordance with the invention, fingers 35 are integral with retaining ring 15, and project outwardly, and also circumferentially, to form J-slots 38. The locations and spacings of the slots are such as to enable them to simultaneously receive the tensioners 20 as the ring 15 is adjustably rotated about the axis 40 of the drum shell, after the ring shoulder 19*a* is seated on the tensioner ring 14. See in this regard FIG. 5 showing ring rotation in direction 41, causing slot 38 to approach tensioner rod 21, which is relatively displaced out of notch 50 by cam surface 51, in response to ring rotation. Rods 21 are initially received in notches 50 spaced about the ring, when the ring 15 is placed on the shell. In order to allow selective travel of tension rods toward the slots, the ring lower wall 18 has its outer surface at 18*a* positioned to closely pass rods of different diameters, as are commonly used with different drums. For this purpose, wall 18 thickness $t_1$ at a region leading toward the entrance to slot 38 may be reduced relative to the wall 18 thickness $t_2$ at a region at the opposite side of the slot, as shown.

It will be noted that the fingers 35 have lips 35*a* projecting circumferentially, as shown, and that they have tapered end terminals, as are provided by tapered surfaces 35*b*. It is found that such terminals can assist in guiding the tensioner rods relatively into the slots 38.

As referred to, an important feature of the invention concerns the provision of relieved zones, such as notches 50 on the ring periphery, as in wall 18 and in stepped portion 19*a* to pass the tensioners endwise upon ring 15 assembly to the drum. At that time, the retainer ring 15 is positioned in rotatably offset or displaced relation to the tensioners 20. See in this regard FIG. 5 showing the tensioner 20 received in the notch 50. The notches are sized to receive tensioners of different diameters, as referred to above. Cam surface or ramp 51 on the notch wall 52 acts to cam the tensioner rod relatively out of the notch, for sliding along wall outer surfaces 18*a* toward the finger formed slots, as the ring is rotated.

Figure 7:
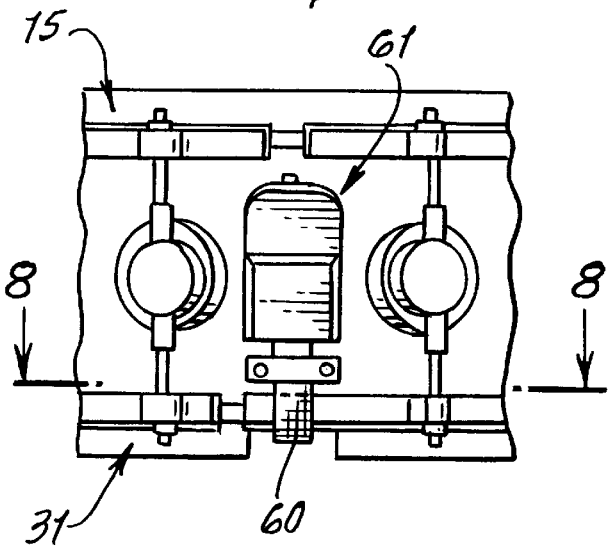
FIG. 7 is a fragmentary elevation showing a drum incorporating a holder strap as also shown in FIG. 7.
Figure 8:
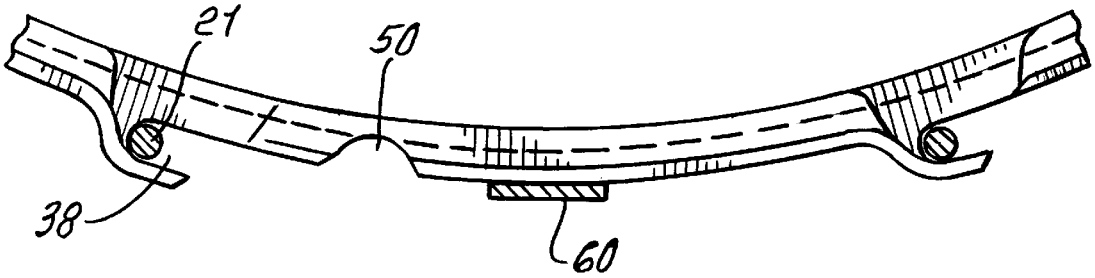
FIG. 8 is a view like FIG. 1 but showing a lower ring having at least one not ch positioned sufficiently closer to the retention slot, so as to avoid interference with a strap that holds an auxiliary device to the drum head.

FIG. 8 is like FIG. 5, except that the notch or notches 50 in lower ring 31 are offset toward the slot or slots 38 sufficiently as to be spaced from the strap 60 which extends between the throw-off device 61 (see FIG. 7) and sounders that are retained adjacent the lower drum head. See U.S. Pat. No. 5,616,875. Therefore, the tensioners 21 do not travel past or over the strap 60 during ring 31 rotation to relatively displace the ring and tensioners, causing their entry into slots 38.

Figure 9:
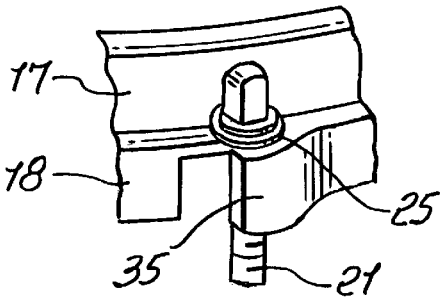
FIG. 9 is a perspective view showing retention of a tension rod in a slot.

FIG. 9 shows a tensioner flange 25 seated on the top surface of the finger 35 and on the adjacent ring wall surface.

FIGS. 1–6 shows the preferred form of the invention. The ring 15 may consist of molded plastic material, or die cast zinc, or aluminum, or composite materials, for example.

The term "ring" as used herein refers to a continuous ring and also to a discontinous ring, as for example a C-shaped body with a split between its opposite opposed ends. Such ends may have an aligner holding them in alignment, or they may slidably interfit, or guided interfit. Such a split ring can be discontinuously adjusted to better fit slightly different diameter drum heads.

I claim:

1. In drum head retention apparatus, the combination comprising a) a ring to extend about the drum, in alignment with head tensioners, and b) fingers projecting on the ring to form slots to rotatably receive and to release from the tensioners, c) relieved zones on the ring to pass the tensioners endwise when the fingers are in rotatably displaced positions relative to the tensioners, d) said relieved zones being in the form of notches sunk in the outer side of the ring, e) and wherein the slots open in directions toward the notches, f) and wherein the ring has outer surface ramps leading into said notches to cam the tensioners out of the notches during ring rotation to cause the slots to receive the tensioners.

2. The combination of claim 1 wherein the fingers have lips extending in the same rotary direction about the drum axis.

3. The combination of claim 1 including said tensioners received in the slots.

4. The combination of claim 1 wherein said relieved zones are at an outer side of the ring and located between successive slots.

5. The combination of claim wherein the ring has reduced wall thickness between the notches and the slots.

6. The combination of claim 1 including seating surfaces on the ring adjacent the slots to seat and position flange surfaces on the tensioners.

7. The combination of claim 6 wherein said seating surfaces are knurled.

8. The combination of claim 1 wherein the fingers have tapered terminals to assist in guiding the tensioners relatively into the slots.

9. The combination of claim 1 wherein the ring has reduced radial thickness along circumferential extents between the notches and the slots.

10. The combination of claim 5 including a strap extending adjacent the ring, the notch closest to said band located between the band and the slot nearest to the notch.

11. The combination of claim 1 wherein the notches have concave inner walls.

12. The combination of claim 1 including a drum having a drum head to which the ring is assembled.

13. The combination of claim 1 wherein the ring is a split ring.

14. The combination of claim 1 including a second ring like that of claim 1, said two rings respectively located at opposite head ends of the drum.

15. The combination of claim 14 including other tensioners received in the slots defined by the second ring.

16. The combination of claim 14 wherein the slots defined by the two rings open in opposite rotary directions.

17. The combination of claim 1 wherein the ring consists of molded plastic material.

* * * * *